US005153600A

United States Patent [19]

Metzler et al.

[11] Patent Number: 5,153,600

[45] Date of Patent: Oct. 6, 1992

[54] MULTIPLE-FREQUENCY STACKED MICROSTRIP ANTENNA

[75] Inventors: Thomas A. Metzler; Richard C. Hall, both of Boulder; Jan M. McKinnis, Lafayette, all of Colo.

[73] Assignee: Ball Corporation, Muncie, Ind.

[21] Appl. No.: 723,860

[22] Filed: Jul. 1, 1991

[51] Int. Cl.[5] ..... H01Q 1/38

[52] U.S. Cl. ..... 343/700 MS; 343/790; 343/846

[58] Field of Search ..... 343/700 MS, 790, 829, 343/830, 846

[56] References Cited

U.S. PATENT DOCUMENTS

| | | | |
|---|---|---|---|
| 3,771,158 | 11/1973 | Hatcher | 343/728 |
| 4,079,268 | 3/1978 | Fletcher et al. | 343/700 MS |
| 4,162,499 | 7/1979 | Jones, Jr. et al. | 343/700 MS |
| 4,218,682 | 8/1980 | Yu | 343/700 |
| 4,233,607 | 11/1980 | Sanford et al. | 343/700 |
| 4,660,048 | 4/1987 | Doyle | 343/700 |
| 4,706,050 | 11/1987 | Andrews | 343/700 MS |
| 4,827,271 | 5/1989 | Berneking et al. | 343/700 |
| 4,835,538 | 5/1989 | McKenna et al. | 343/700 |
| 4,835,539 | 5/1989 | Paschen | 343/700 |
| 5,041,838 | 8/1991 | Liimatainen et al. | 343/700 MS |

OTHER PUBLICATIONS

Mattheai et al., *Microwave Impedance-Matching Networks and Coupling Structures,* Chapter 4, pp. 83-162 (Artech House Books, 1980).

*Primary Examiner*—Michael C. Wimer
*Assistant Examiner*—Hoanganh Le
*Attorney, Agent, or Firm*—Gilbert E. Alberding

[57] ABSTRACT

A multiple-frequency stacked microstrip patch antenna structure is disclosed which provides substantially increased isolation between the multiple radiating elements and between the multiple feed elements. In one embodiment of the present invention having two radiating elements, such isolation is afforded by disposing shielding around a portion of the feed pin connected to the upper radiating element by electrically connecting the reference surface with the lower radiating element. Additional isolation and improved response characteristics can be provided by employing a tuning network for each radiating element. Additionally, two or more sets of stacked radiating elements can be arranged in an array to provide increased gain or directivity capabilities.

16 Claims, 9 Drawing Sheets

E-PLANE RADIATION
(1.9 GHZ)

E-PLANE RADIATION
(2.4 GHZ)

SWEPT BORESIGHT GAIN

—— LOW PORT TO HIGH PORT
PORT-TO-PORT ISOLATION

MULTIPLE-FREQUENCY STACKED MICROSTRIP ANTENNA

The U.S. Government has a paid-up license in this invention and the right in limited circumstances to require the patent owner to license others on reasonable terms as provided for by the terms of Contract No. F33615-88-C1768, awarded by Air Force Systems Command.

FIELD OF THE INVENTION

This invention relates generally to microstrip antennas, and more particularly, to a multiple-frequency microstrip antenna having improved isolation characteristics.

BACKGROUND OF THE INVENTION

In certain applications, it is desirable or necessary to employ a multiple-frequency antenna having the following features: relatively broad bandwidth (about 10% or more); significant isolation between frequencies; ability to transmit/receive copolarized radiation; reliable; small size and low profile; and, easily produced at low cost.

One application in which the foregoing antenna characteristics may be desirable is in a two-way communication system which can transmit and receive signals simultaneously on separate frequencies. Broad bandwidth and isolation between the transmitting and receiving bands are important capabilities. Small size and low profile are particularly advantageous in mobile applications, including airborne radar arrays.

Microstrip antennas have been used in the foregoing applications and are known to be reliable and easily produced at a low cost. They are also small and have low profiles. A microstrip antenna generally includes a dielectric substrate having an electrically conductive reference surface disposed on one side and an electrically conductive radiating element disposed on the opposite side. The radiating element can be fed directly, such as with a co-axial connector or microstrip transmission line, or can be capacitively coupled to a feed. Bandwidths in excess of 10% can be achieved and individual microstrip antennas can be interconnected to form an array. Additionally, the small size and low profile of microstrip antennas enable them to be used where a conformal structure is required.

One known configuration of a multiple-frequency microstrip antenna comprises separate, adjacent, coplanar radiating elements disposed on a surface of a dielectric substrate (with a reference surface disposed on the opposite surface of the substrate). Feed locations on the radiating elements are selected for impedance matching and copolarized radiation can be accommodated; however, radiation from two adjacent radiating elements will not share a common phase center, making the layout of elements in an array more difficult to design. Furthermore, the use of such adjacent, coplanar elements is an inefficient use of space, a distinct deficiency in applications where space is at a premium. In order to meet broad bandwidth and out-of-band rejection requirements, the dielectric substrate must be relatively thick which can increase undesirable element-to-element coupling in an array. And, it will be appreciated that because the radiating elements share a single dielectric substrate having a single thickness, antenna performance cannot be optimized for each separate band.

In another known arrangement,.a single, dual-polarized radiating element is dimensioned to resonate at two frequencies in two orthogonal modes of excitation. However, such an arrangement suffers from gain isolation problems when, for example, polarized waves are received that are not aligned with a principal plane of the antenna. Clearly, copolarized radiation cannot be accommodated. Nor is it possible to optimize the Q-factor for each resonant frequency since the Q-factor is determined by the nonresonant dimension of a radiating element and by the substrate thickness. In the single element, dual-polarized configuration, the non-resonant dimension at one frequency is the resonant dimension at the other frequency. Thus, both the length and the width of the radiating element are determined by the desired resonant frequencies and it becomes difficult to adjust them to improve the Q-factor. And, because the antenna comprises a single radiating element on a single substrate, the substrate thickness cannot be optimized for both resonant frequencies. Consequently, radiation at the higher frequency will have a lower Q-factor and a broader response curve with roll-off characteristics which are undesirable in applications requiring good isolation between the operating bands.

Stacked microstrip antennas have also been used, comprising two or more radiating elements disposed above and parallel to a reference surface, separated from each other and the reference surface by dielectric layers. In some such antennas, a single feed is connected to one of the radiating elements and the one or more other radiating elements are electromagnetically coupled to the directly fed element. Alternatively, each radiating element can be separately and directly fed. It can be appreciated, however, that undesirable coupling can occur between radiating elements and between the feed elements, coupling which increases when the thicknesses of the dielectric layers are increased to obtain broader bandwidth. Such coupling is particularly pronounced when the radiation to/from the elements is copolarized. Furthermore, the roll-off characteristics may not permit the antenna to be used in a simultaneous, multi-frequency application.

OBJECTS AND SUMMARY OF THE INVENTION

It is an object of the present invention to provide a reliable, low-cost and easily produced multiple-frequency antenna having relatively broad bandwidth and increased isolation characteristics suitable for simultaneous operation on different frequencies.

It is a further object of the present invention to provide such an antenna in which the broad bandwidth and increased isolation characteristics are maintained when the radiated energy at the multiple frequencies is copolarized.

It is a further object of the present invention to provide such an antenna which is adaptable to an array configuration.

In accordance with the present invention, a multiple-frequency stacked microstrip antenna structure is provided having an electrically conductive reference surface, a first radiating element substantially parallel to the reference surface and separated therefrom by a first dielectric layer, a second radiating element substantially parallel to the first radiating element and separated therefrom by a second dielectric layer, first and second feed elements for the first and second radiating elements, respectively, and an isolating means to substantially isolate one radiating element and its associated feed elements from the other radiating element and its associated feed element.

The isolating means includes a shielding component disposed around a portion of the second feed element but free from contact therewith. The shielding component electrically connects the reference surface to the first radiating element. The isolating means can also include a tuning network to improve the ripple and roll-off characteristics of the radiating elements, thereby further improving gain isolation and port-to-port isolation. In one embodiment, the tuning network is a two-stage filter having band pass characteristics which can be implemented as stripline circuitry disposed on a third dielectric layer below the reference surface.

Additional frequencies can be accommodated by stacking additional radiating elements in the antenna structure and providing additional feed elements and isolation elements.

The benefits of the present invention are particularly advantageous when two or more sets of stacked radiating elements are arranged in an array having increased gain or directivity capabilities.

The antenna structure of the present invention is capable of providing bandwidths of at least 10% in each of the operating bands; the center of frequencies of the operating bands can be separated by as little as 20% of the higher frequency; isolation between the bands can be 20 dB or greater with in-band ripple of 0.5 dB or less. Further, the antenna structure is reliable, small and has a low profile, and can be easily produced at low cost.

DETAILED DESCRIPTION OF THE PREFERRED EMBODIMENT

Figure 1:
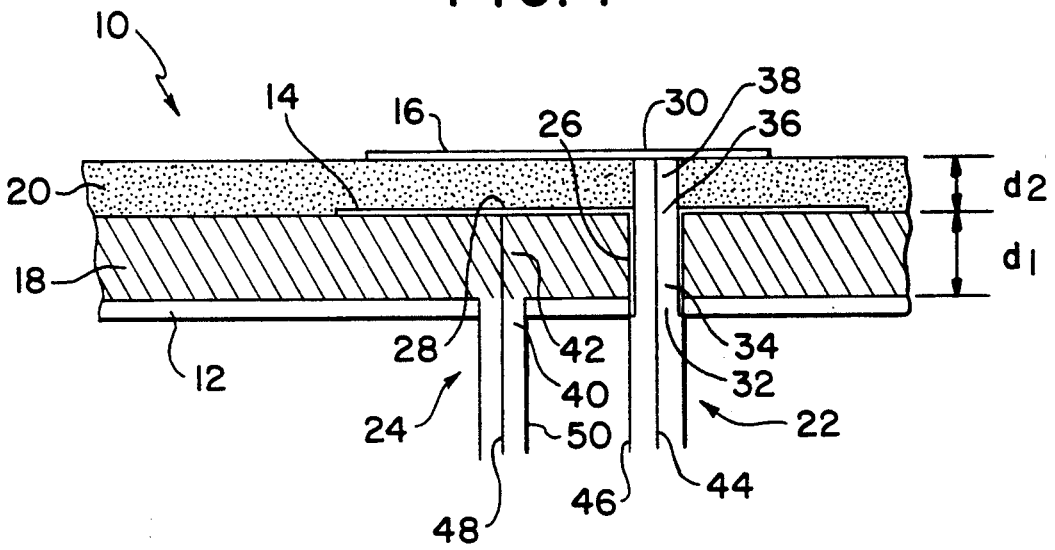
FIG. 1 is a cross-sectional view of one embodiment of the multiple-frequency antenna structure of the present invention.
Figure 2:
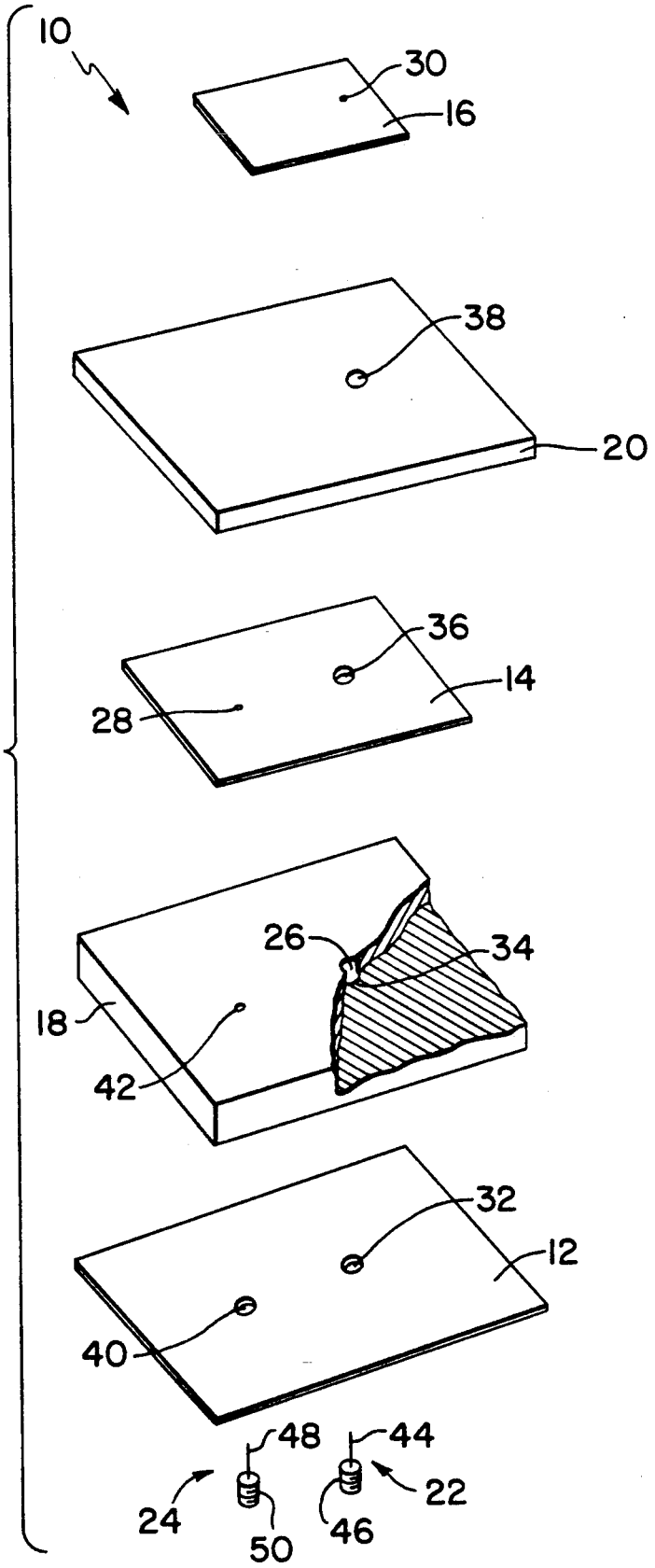
FIG. 2 is an exploded perspective view of the embodiment illustrated in FIG. 1, with a portion cutaway.

FIGS. 1 and 2 are a cross-sectional view and an exploded perspective view (with a portion cut-away), respectively, of one embodiment of a multiple-frequency antenna structure 10 of the present invention. Antenna structure 10 includes an electrically conductive reference surface (e.g., ground plane) 12, a first microstrip radiating element 14 dimensioned to resonate at a first resonant frequency and a second microstrip radiating element 16 dimensioned to resonate at a second resonant frequency. First radiating element 14 is substantially parallel to reference surface 12 and is separated therefrom by a first dielectric layer 18. Second radiating element 16 is substantially parallel to first radiating element 14 and is separated therefrom by a second dielectric layer 20.

A first feed element 24 is secured to the underside of reference surface 12 and connects first radiating element 14 with a transmitting/receiving device (e.g., a radio transceiver). A second feed element 22 is similarly secured to the underside of reference surface 12 and connects second radiating element 16 to a transmitting-/receiving device. Together, first radiating element 14 and first feed element 24 comprise a first antenna section. Together, second radiating element 16 and second feed element 22 comprise a second antenna section.

Antenna structure 10 also includes an isolating means having a shielding component 26 disposed around a portion of second feed element 22 within first dielectric layer 18. First radiating element 14 has a feed location 28 positioned to provide substantial impedance matching between first radiating element 14 and first feed element 24; second radiating element 16 has a feed location 30 positioned to provide substantial impedance matching between second radiating element 16 and second feed element 22. A first set of holes 32, 34, 36 and 38 are formed through reference surface 12, first dielectric layer 18, first radiating element 14 and second dielectric layer 20, respectively, in substantial registration (or alignment) with feed location 30 on second radiating element 16. A second set of holes 40 and 42 are formed through reference surface 12 and first dielectric layer 18, respectively, in substantial registration with feed location 28 on first radiating element 14. Second feed element 22 includes an inner, signal-carrying conductor (feed pin) 44 disposed through openings 32, 34, 36 and 38 and electrically secured, such as by soldering, to second radiating element 16 at feed location 30. Second feed element 22 also includes a reference conductor 46 surrounding the portion of signal-carrying conductor 44 which is below reference surface 12; it is electrically secured to reference surface 12, such as by soldering, at a location adjacent to opening 32. Similarly, first feed element 24 includes an inner, signal-carrying conductor (feed pin) 48 disposed through opening 40 and 42 and electrically secured, such as by soldering, to first radiating element 14 at feed location 28. First feed element 24 also includes an outer reference conductor 50 surrounding the portion of signal-carrying conductor 48 which is below reference surface 12 it is electrically secured to reference surface 12 at a location adjacent to opening 40.

Shielding component 26 .includes electrically conductive material disposed on the walls of opening 34 in the first dielectric layer 18. Signal-carrying conductor 44 extends through opening 34 but free from electrical contact with shielding component 26. The electrically conductive material is electrically connected to reference surface 12 at a location adjacent to opening 32 and to first radiating element 14 at a location adjacent to opening 36. Thus, shielding component 26 electrically connects reference surface 12 with first radiating element 14 resulting in an electrical extension of reference conductor 46 around signal-carrying conductor 44 through first dielectric layer 18. Such electrical connection can be achieved by direct electrical contact (shown in FIG. 1) such as by soldering, or can be achieved by other means of electrically connecting reference surface 12 to first radiating patch 14 to realize improved isolation. It can be appreciated that electrical contact between shielding component 26 and signal-carrying conductor 44 would prevent signals from radiating from second radiating element 16. Preferably, shielding component 26 is a metallized via through opening 34 in first dielectric layer 18. A hole can be drilled through the metallization and the inner surface insulated to prevent electrical contact between signal-carrying conductor 44 and isolating component 26.

First and second dielectric layers 18 and 20 can be any low-loss dielectric material, such as teflon-fiberglass. It will be appreciated that a material having a dielectric constant higher or lower than that of teflon-fiberglass can also be used (e.g., to increase bandwidth or decrease the size or weight of the antenna). First dielectric layer 18 has a thickness d1 and second dielectric layer 20 has a thickness d2, generally different from d1. The bandwidth of each radiating element 14 and 16 is principally determined by the thickness and dielectric constant of first and second dielectric layers 18 and 20. As will be discussed below, the isolating means can include a tuning network to tailor the response, including the bandwidth, of radiating elements 14 and 16 to a particular application to further improve isolation. Additionally, in applications in which the bandwidths of first and second radiating elements 14 and 16 are substantially the same, the dielectric layer associated with the radiating element having the lower resonant frequency can be thicker than the dielectric layer associated with the radiating element having the higher resonant frequency, as shown in FIG. 1. Alternatively, materials having different dielectric constants can be used if, for example, it is desired to reduce overall thickness of antenna structure 10 while maintaining a desired bandwidth. Thus, the overall performance of antenna structure 10 can be enhanced by separately adjusting the properties of the individual dielectric layers 18 and 20. The dielectric layers are secured to each other with an adhesive bonding agent, preferably having a dielectric constant which substantially matches the dielectric constant of the dielectric layers.

Reference surface 12, first radiating element 14 and second radiating element 16 can be disposed on the surfaces of first and second dielectric layers 18 and 20 by a photo-etching process or can be applied as a thick-film metallized paste in a silk screen printing process. These methods are reliable, lend themselves to accurate registration of the components and lend themselves to low cost production of antennas. Although first and second radiating elements 14 and 16 are illustrated in FIGS. 1 and 2 as being rectangular, one-half wavelength elements, the present invention is not limited to radiating elements of a particular shape or size. Additionally, although first radiating element 14 is shown in FIGS. 1 and 2 as being larger than second radiating element 16, and therefore having a lower resonant frequency, the present invention is not limited to this particular configuration.

In operation, a signal at a first radio frequency (or within a first band) is conveyed to first radiating element 14 through first feed element 24 from a transmitter and a signal at a second radio frequency (or within a second band) is conveyed to second radiating element 16 through second feed element 11 from a transmitter. (Although the operation of antenna structure 10 is generally described herein in terms of transmitting radio frequency signals, the description is equally applicable to reception of radio frequency signals and the present invention is not limited to one particular mode of operation. Further, the present invention can be adapted to simultaneously transmit on a first frequency and receive on a second frequency or to operate on the two frequencies alternatively.) Shielding component 26 causes first radiating element 14 to serve as a reference surface (e.g., ground plane) for second radiating element 16 operating at or around its resonate frequency. Shielding component 26 also serves to substantially prevent radio frequency signals on signal-carrying conductor 44 from coupling to first radiating element 14 or to signal-carrying conductor 48 and to substantially prevent signals on signal-carrying conductor 48 from coupling to second radiating element 16 or to signal-carrying conductor 44. Energy from first radiating element 14 radiates from apertures defining a cavity between reference surface 12 and first radiating element 14. Energy from second radiating element 16 radiates from apertures defining a cavity between first radiating element 14 and second radiating element 16. First and second antenna segments are substantially decoupled, increasing gain isolation and port-to-port isolation (hereinafter "frequency isolation") and enabling simultaneous transmission/reception on the first and second resonant frequencies (known as diplexing operation), as desired.

Figure 3:
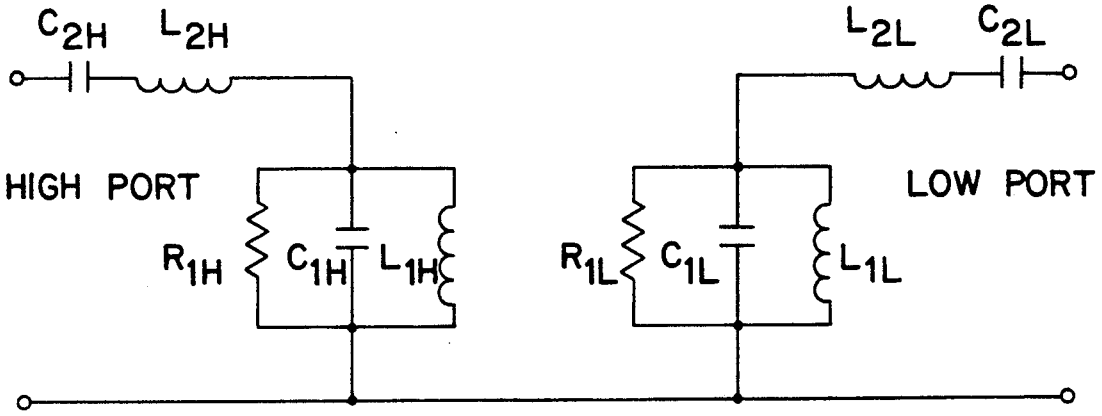
FIG. 3 is a circuit model of the embodiment illustrated in FIG. 1.

The two antenna sections of antenna structure 10 (each antenna section having a radiating element and its associated feed element) can be modeled by the parallel RLC circuit shown in FIG. 3 in which it can be seen that isolating component 26 substantially decouples the two antenna sections. For purposes of this description, first radiating element 14 is assumed to have a longer resonant dimension than second radiating element 16 and, therefore, have a lower resonant frequency. A first portion of each side of the circuit model (i.e., low port side and high port side), comprising resistance R1, capacitive reactance C1 and inductive reactance L1 of the respective antenna section, is generally representative of the microstrip radiating element itself with the values of R1, C1 and L1 generally determinative of the bandwidth of the particular antenna section. These values, in turn, are determined by the physical characteristics of the antenna section, including the dimensions of the radiating element, the thickness and dielectric constant of the dielectric layer on which the radiating element is disposed, and the position of the feed location on the radiating element.

The series inductive reactances, L2, in each second portion of the circuit model is generally representative of the feed element connected to the radiating element and its value is determined by the dimensions of the signal-carrying conductor (feed pin), particularly its diameter.

Substantially decoupling the first and second antenna segments with shielding component 26 provides an accompanying benefit; it facilitates the design of antenna structure 10 by permitting first and second antenna segments to be treated substantially separately and independently. For example, to design antenna structure 10 to operate at two resonant frequencies, f1 and f2, each having desired response and bandwidth characteristics, first one antenna segment can be designed and then the other. Then, the two can be combined in a single structure. One skilled in the art can readily appreciate the advantage of designing the antenna segments separately rather than attempting to compensate for, or neutralize, mutual coupling. This latter process frequently entails numerous iterations of designing, constructing and testing steps, adjusting various parameters until satisfactory performance is obtained.

An exemplary antenna structure 10 for L-band operation was constructed in which first radiating element 14 was dimensioned to resonate at approximately 1.9 GHz and second radiating element 16 was dimensioned to resonate at approximately 2.4 GHz, representing a frequency separation of about 20 percent (the difference between the two frequencies divided by the upper frequency times 100%). First and second radiating elements 14 and 16 were one-half wavelength elements. To achieve bandwidths of at least 10 percent in both bands, first and second dielectric layers 18 and 20 were chosen to be about Teflon-fiberglass a dielectric constant of about 2.3, with first dielectric layer 18 being thicker than second dielectric layer 20. Feed locations 28 and 30 on first and second radiating elements 14 and 16 were positioned along a center axis of each radiating element at a point at which the impedance of the radiating element substantially matched 25 ohm transmission coaxial cables to be attached to first and second feed elements 22 and 24. The feed locations were also selected to enable both first and second radiating elements 14 and 16 to radiate (or receive) linearly polarized energy of the same polarization (copolarized radiation) and to have substantially coinciding phase centers. Antenna structure 10 can be scaled to other frequencies, including frequencies in the X-band or higher, and still maintain the foregoing bandwidth, separation and isolation characteristics.

Figure 4:
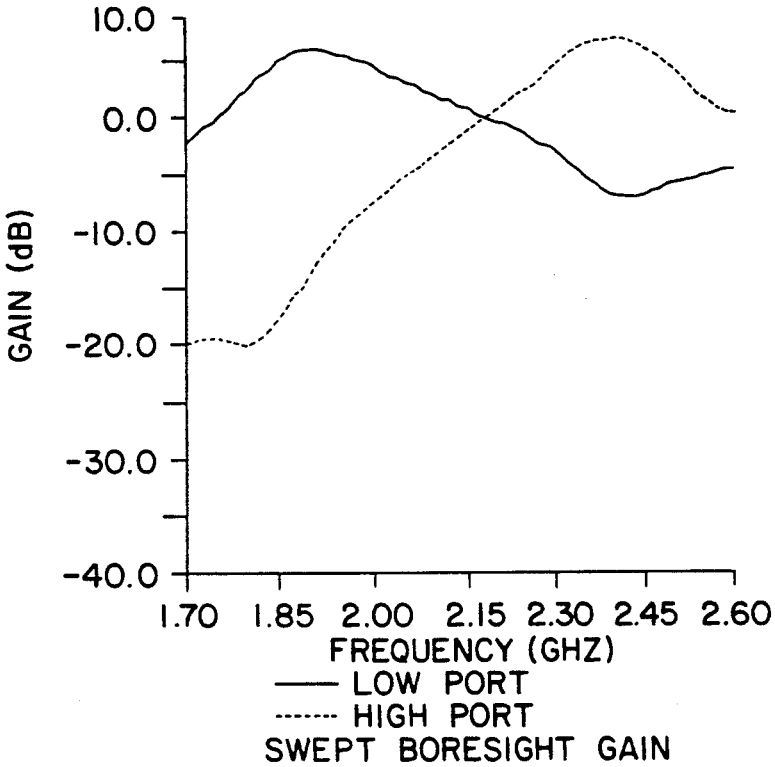
FIG. 4 is a graph of the swept boresight antenna gain of an exemplary antenna structure of the embodiment illustrated in FIG. 1.
Figure 5:
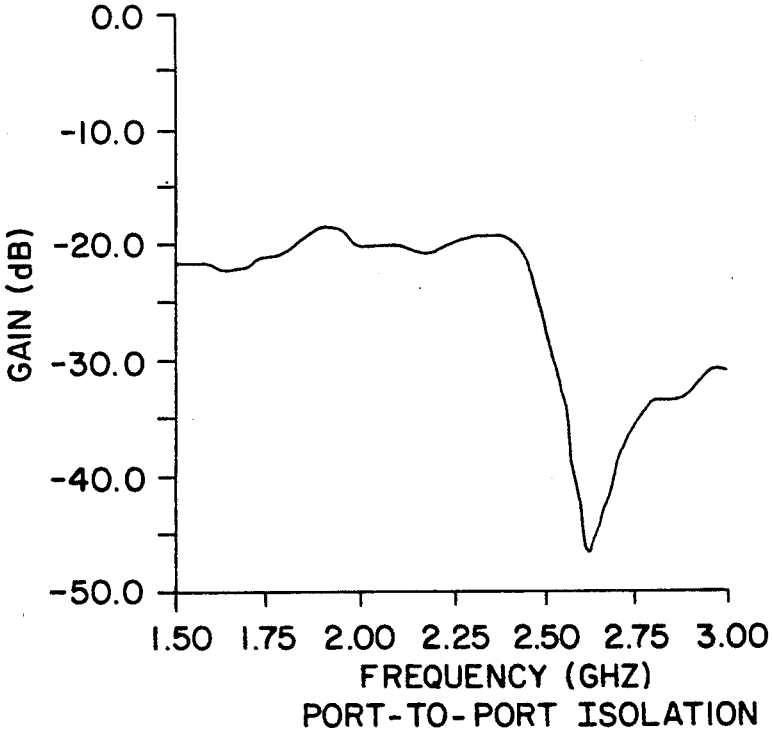
FIG. 5 is a graph of the port-to-port isolation between antenna sections of the exemplary antenna structure.
Figure 6A:
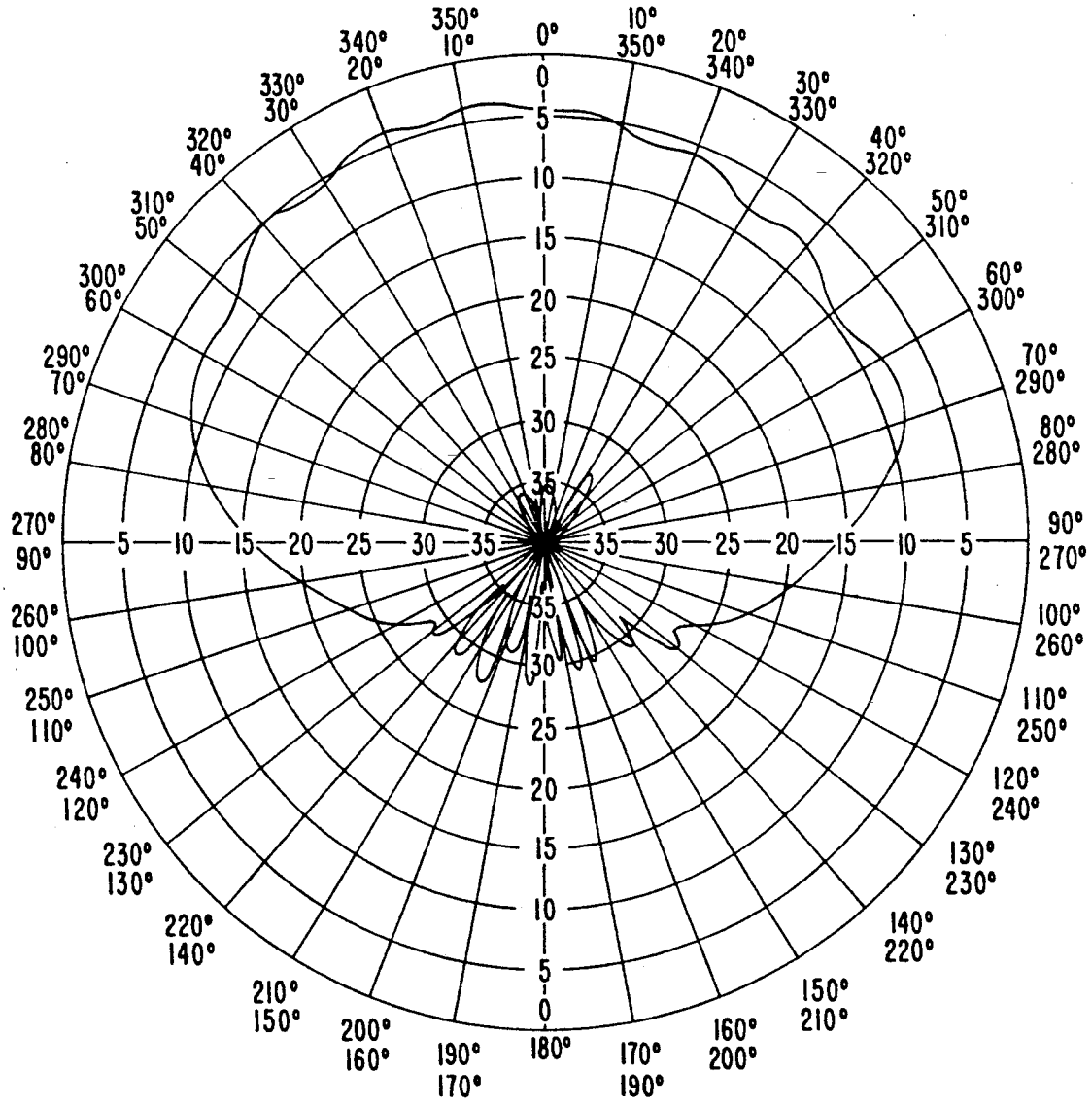
FIGS. 6A and 6B are graphs of the E-plane radiation patterns of the exemplary antenna structure.
Figure 6B:
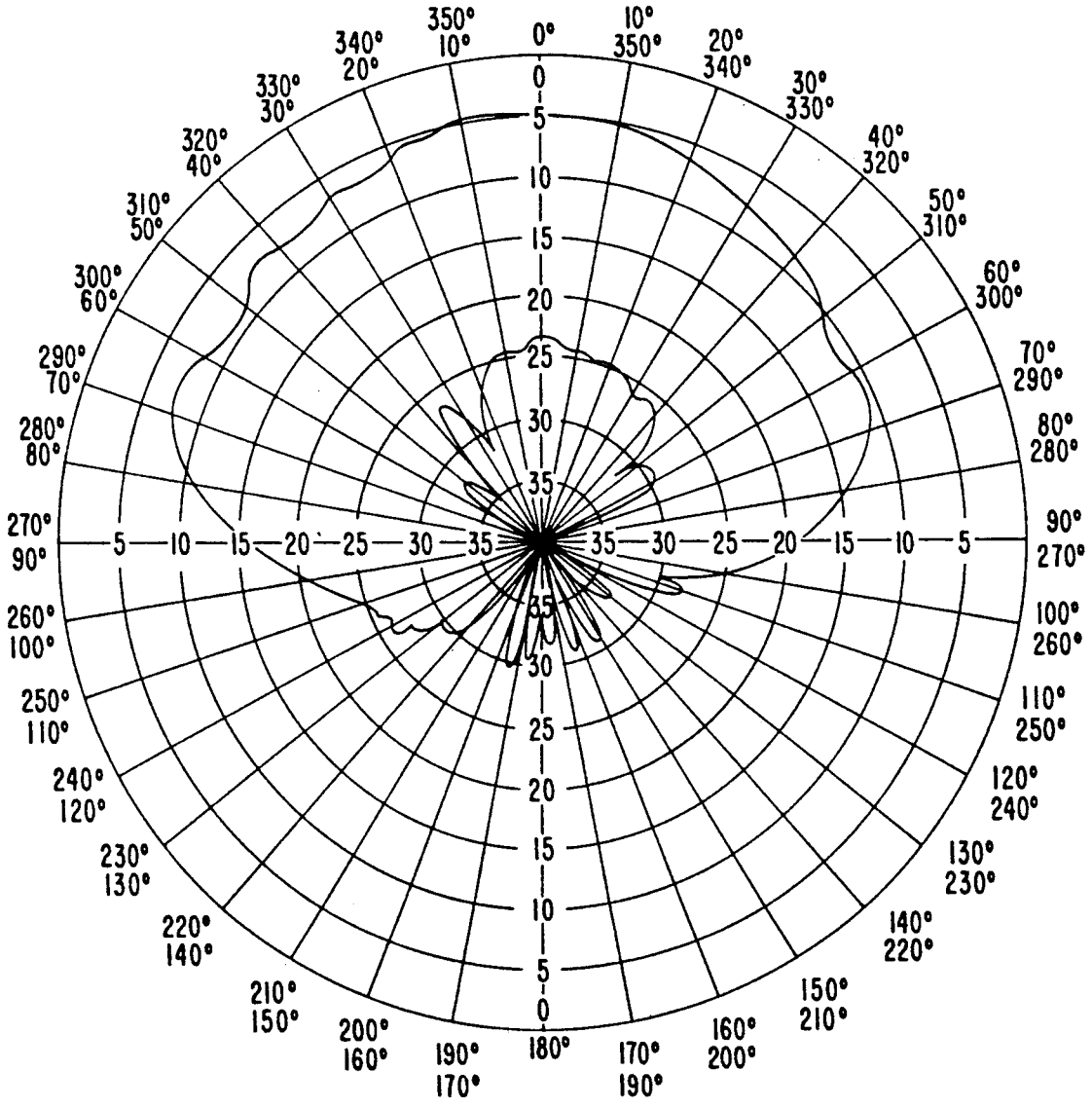

FIGS. 4–6 graphically illustrate measurements of various characteristics of the antenna structure constructed to the foregoing parameters. FIG. 4 is a graphical representation of the swept boresight antenna gain of first radiating element 14 (low port) and second radiating element 16 (high port). As can be seen in FIG. 4, the gain for each radiating element is at or near a minimum when the gain for the other radiating element is at or near a maximum, showing the good gain isolation between the two antenna sections during use.

FIG. 5 illustrates the port-to-port isolation between first and second antenna sections. Port-to-port isolation of at least about −20 dB is obtained over the entire frequency range tested, an improvement of approximately 12 dB over the isolation obtained without isolating component 26.

FIGS. *6a* and *6b* illustrate the E-plane radiation patterns of first and second antenna segments at 1.9 GHz and 2.4 GHz, respectively. These graphs illustrate the substantially uniform radiation pattern (isotropic) of antenna structure 10 at both frequencies down to approximately 20° elevation above the horizon.

Figure 7:
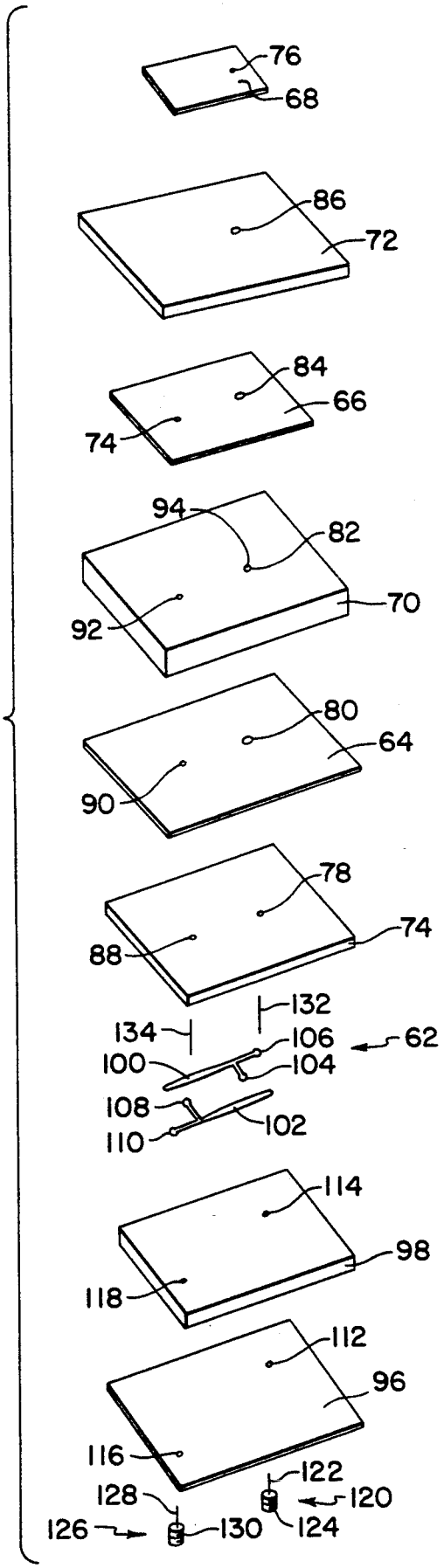
FIG. 7 is an exploded perspective view of another embodiment of the present invention.

FIG. 7 illustrates another embodiment of an antenna structure 60 of the present invention in which the isolating means includes a tuning or matching network 62 to further tailor the performance characteristics of the antenna including, in particular, frequency isolation between the antenna sections. Antenna structure 60 includes a reference surface (e.g., ground) 64, a first radiating element 66 and a second radiating element 68. First radiating element 66 is substantially parallel to reference surface 64 and is separated therefrom by a first dielectric layer 70. Second radiating element 68 is substantially parallel to first radiating element 66 and is separated therefrom by a second dielectric layer 72. To realize linear polarization, first and second radiating elements 66 and 68 have feed locations 74 and 76, respectively, along a center line parallel to the resonant dimension in positions where the input impedance of each radiating element substantially matches the impedance of the respective feed element. Other polarizations can also be realized with other feed location positions.

A first set of openings 78, 80, 82, 84 and 86 are formed through third dielectric layer 70, reference surface 64, first dielectric layer 70, first radiating element 66 and second dielectric layer 72, respectively, in substantial registration with feed location 76 on second radiating element 68. A second set of openings 88, 90 and 92 are formed through third dielectric layer 74, reference surface 64 and first dielectric layer 70, respectively, in substantial registration with feed location 74 on first radiating element 66. The isolating means of antenna structure 60 employs a shielding component 94 which electrically connects reference surface 64, adjacent to or around hole 80, to first radiating element 66, adjacent to or around hole 84.

The isolating means also includes tuning network 62, preferably disposed below reference surface 64, substantially parallel thereto and separated therefrom by a third dielectric layer 74. A second reference surface 96 is disposed below tuning network 62, substantially parallel thereto and separated therefrom by a fourth dielectric layer 98. It is electrically connected to reference surface 64. Such placement facilitates the design and production of antenna structure 60. Tuning network 62 includes a first stripline circuit 102, associated with first radiating element 66, and a second stripline circuit 100, associated with second radiating element 68. First stripline circuit 102 has a first contact pad 108 in substantial registration with feed location 74 on first radiating element 66. Second stripline circuit 100 has a first contact pad 104 in substantial registration with feed location 76 on second radiating element 68. A third set of openings 112 and 114 are formed through second reference surface 96 and fourth dielectric layer 98, respectively, in substantial registration with a second contact pad 106 on second stripline circuit 100. A fourth set of openings 116 and 118 are formed through second reference surface 96 and fourth dielectric layer 98, respectively, in substantial registration with a second contact pad 110 on first stripline circuit 102.

A first feed element 126 is secured to the underside of second reference surface 96. It includes an inner, signal-carrying conductor 128 disposed through openings 116 and 118 in second reference surface 96 and fourth dielectric layer 98 and electrically connected to first stripline circuit 102 at first contact pad 110. A reference conductor 130, surrounding the portion of signal-carrying conductor 128 which is below second reference surface 96, is electrically connected to second reference surface 96. A second feed element 120 is secured to the underside of second reference surface 96. It includes an inner, signal-carrying conductor 122 disposed through openings 112 and 114 in second reference surface 96 and fourth dielectric layer 98 and electrically connected to second stripline circuit 100 at first contact pad 104. A reference conductor 124, surrounding the portion of signal-carrying conductor 122 which is below second reference surface 96, is electrically connected to second reference surface 96.

A first feed pin 134 is disposed through the second set of openings 88, 90 and 92 and is electrically connected to second contact pad 108 on first stripline circuit 102 and to first radiating element 66 at feed location 74. A second feed pin 132 is disposed through the first set of openings 78, 80, 82, 84 and 86 and is electrically connected to second contact pad 104 on second stripline circuit 100 and to second radiating element 68 at feed location 76.

Figure 8:
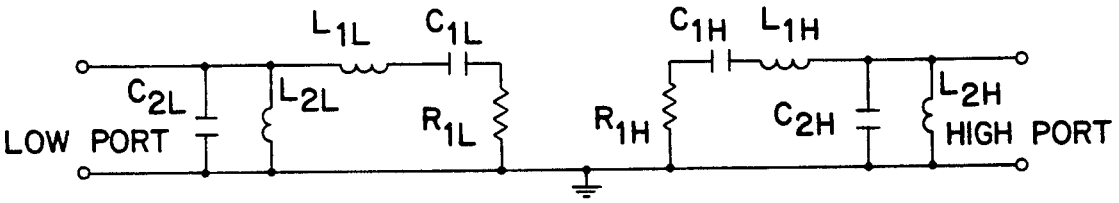
FIG. 8 is a two-stage filter circuit model of the embodiment illustrated in FIG. 7.

Antenna structure 60, with the two antenna sections and tuning network 62, can be modeled by the two-sided, two-stage series RLC filter circuit shown in FIG. 8. The antenna impedances have been transformed through appropriate line lengths, comprised of the openings and associated line lengths on the stripline circuits, such that they can be modeled as series RLC circuits. Tuning networks 100 and 102 implement the required shunt capacitances. First radiating element 64 is again assumed to have a lower resonant frequency than second radiating element 66. The first stage of network 62 is comparable to the first stage of the circuit model of FIG. 3 (although, because a series model and not a parallel model is used, the values of the components are not necessarily the same). The filter's first stage, comprising resistance R1, capacitive resistance C1 and inductive reactance L1 of the respective antenna section, is representative of the microstrip radiating element itself with the values of R1, C1 and L1 generally determinative of the bandwidth of the particular antenna section. The components in each second stage of the circuit model, capacitive and inductive reactances C2 and L2, primarily affect the ripple and roll-off characteristics of the antenna section.

Figure 9:
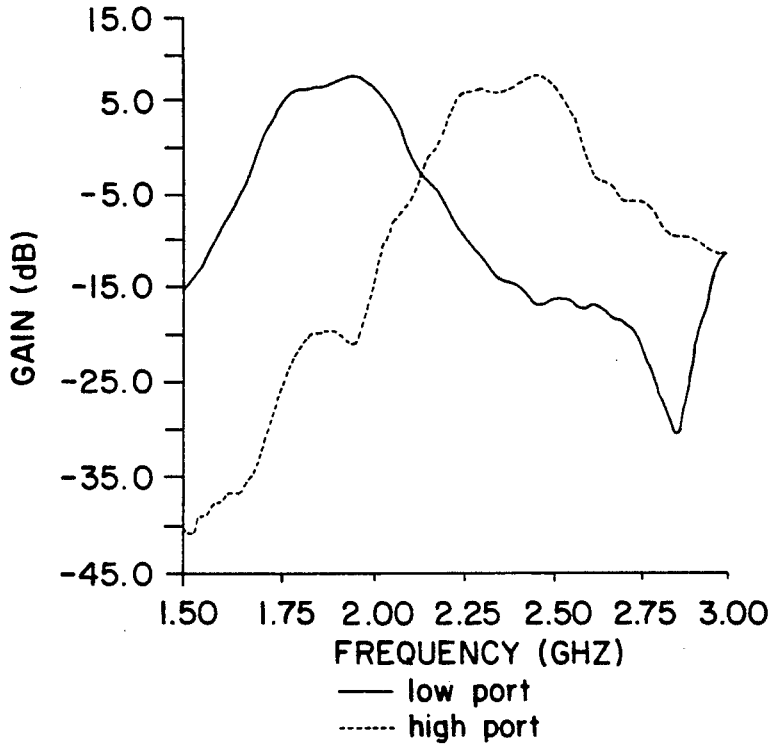
FIG. 9 is a graph of the swept gain of an exemplary antenna structure of the embodiment illustrated in FIG. 7.
Figure 10:
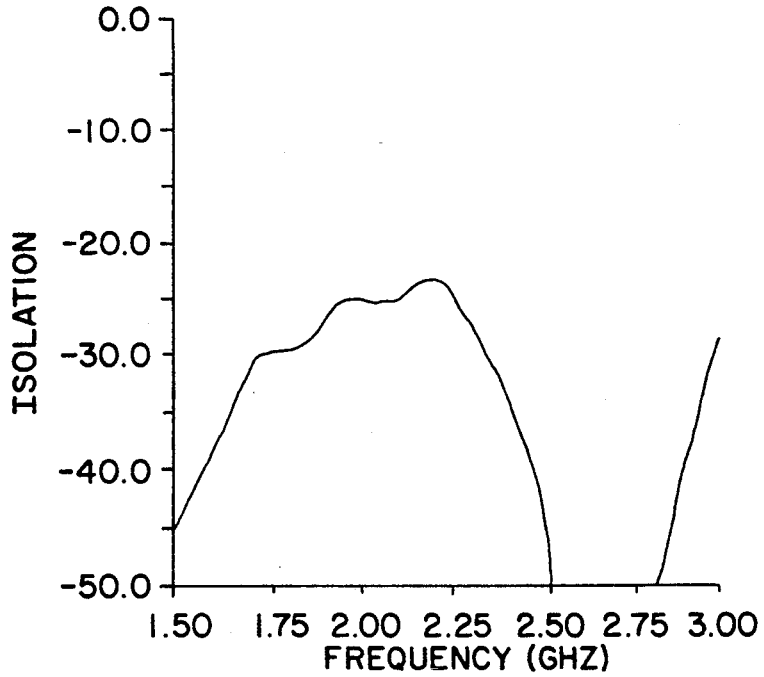
FIG. 10 is a graph of the port-to-port isolation of the exemplary antenna structure of the embodiment illustrated in FIG. 7.

FIGS. 9 and 10 graphically illustrate performance characteristics of a multiple-frequency antenna structure with a two-stage filter. FIG. 9 illustrates the swept gain of the two radiating elements; gain isolation at the center frequencies of 1.9 GHz and 2.4 GHz is at least 20 dB. FIG. 10 illustrates the port-to-port isolation over the range of operational frequencies. It can be seen that the isolation exceeds 20% over the entire range.

Figure 11:
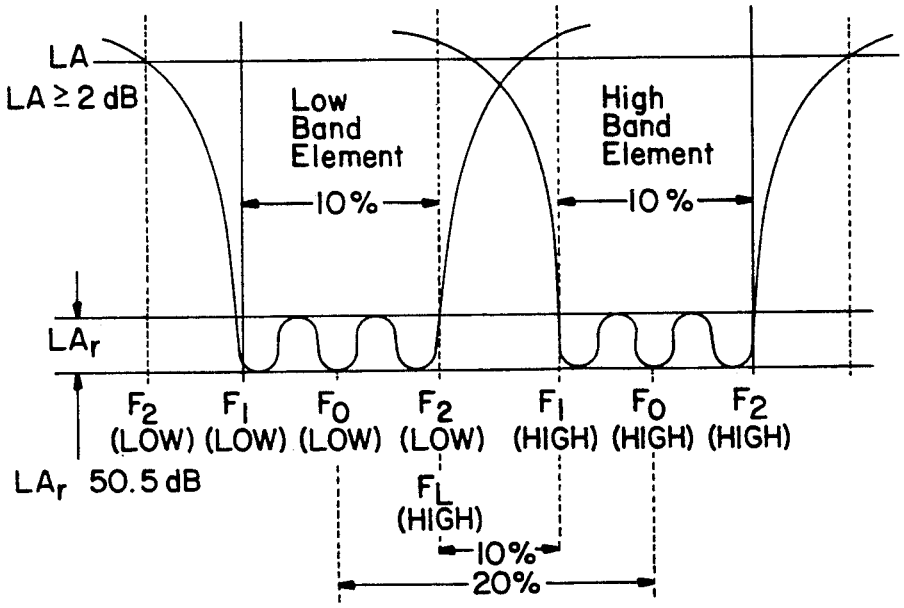
FIG. 11 is a response curve in which a desired return loss is plotted against frequency.

In some applications, the characteristics provided by two stages may be satisfactory. However, in some other applications, such as diplexed operation, it may be necessary or desirable to further reduce ripple and sharpen the roll-off characteristics in order to provide increased frequency isolation between the two antenna sections. For example, FIG. 11 illustrates a response curve in which a desired return loss is plotted against frequency. The centers of the two operating bands are separated by about 10%, each band has a bandwidth of about 20%, separation between the upper frequency of the lower band and the lower frequency of the upper band is about 10%, ripple ($LA_r$) is no greater than 0.5 dB and isolation (LA) between the bands (within each 10% bandwidth) is at least 20 dB.

Figure 12:
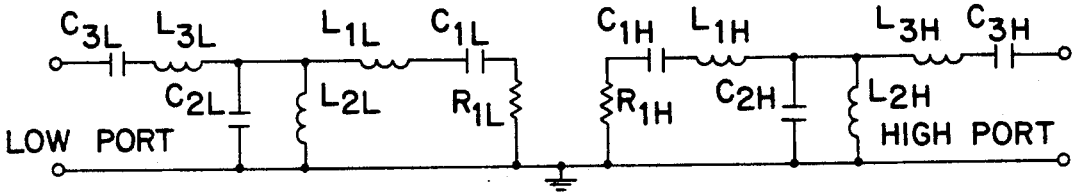
FIG. 12 is a three-stage filter circuit model of an embodiment of the present invention.

To obtain such characteristics, a third stage in the filter can be incorporated, as shown in the circuit model of FIG. 12. In each stage three, C3 and L3 represent added capacitive and inductive reactances at the base of the feed pin, and their presence can provide desired tailoring of the ripple and roll-off characteristics of the antenna section. These can be implemented by additional circuitry on the striplines.

The design of a three-stage band pass filter is detailed in Chapter 4 of *Microwave Impedance-Matching Networks and Coupling Structures* by Mattheai et al. (Artech House Books, Dedham, Mass., 1980) and is summarized as follows: it begins with the selection of a desired in-band ripple (or its equivalent VSWR) or out-of-band isolation characteristics for a particular application. Table 1 is a comparison of exemplary values of ripple and the corresponding values of isolations for two frequency bands having 10% bandwidth and 20% separation:

TABLE 1

| Pass-band Ripple | Equivalent VSWR | Isolation |
|---|---|---|
| 0.01 dB | 1.10:1 | 11.3 dB |
| 0.1 dB | 1.36:1 | 21.5 dB |
| 0.2 dB | 1.54:1 | 24.8 dB |
| 0.5 dB | 1.98:1 | 28.5 dB |

It can be seen, for example, that isolation of 28.5 dB can be achieved if ripple of 0.5 dB (VSWR 2.0:1 maximum) is acceptable. Once the isolation has been determined (either directly or indirectly based upon ripple), decrement factor $\delta$ is calculated or determined graphically using design aids presented in Mattheai et al. for N=3 stages. Filter coefficients g1, g2 and g3 are similarly calculated or determined. The physical parameters of the radiating elements are then determined (including element dimensions, thickness and dielectric constant of the dielectric material, and feed location), and the values of the filter components for each antenna section can be calculated as follows:

$$R_1 = \frac{R_g}{g_4}$$

$$C_1 = \frac{g_1}{R(\omega_2 - \omega_1)}$$

$$L_1 = 1/\omega_o^2 C_1$$

$$L_2 = \frac{g_2 R_o}{\omega_2 - \omega_1}$$

$$C_2 = 1/\omega_o^2 L_2$$

$$C_3 = \frac{g_3}{R_o(\omega_2 - \omega_1)}$$

$$L_3 = 1/\omega_{o2} C_3$$

where $\omega_1$, and $\omega_2$ are the radian frequencies defining the pass band and $$\omega_o = \tfrac{1}{2}(\omega_1 + \omega_2).$$

If necessary, the feed location or feed pin dimensions can be changed in order to achieve the desired values in stages one and two. The capacitive and inductive reactances of each stage three of the filter can be implemented using additional stripline circuitry in tuning network 62 of FIG. 7. Additional filter stages can be employed to further adjust the response of an antenna structure.

Figure 13:
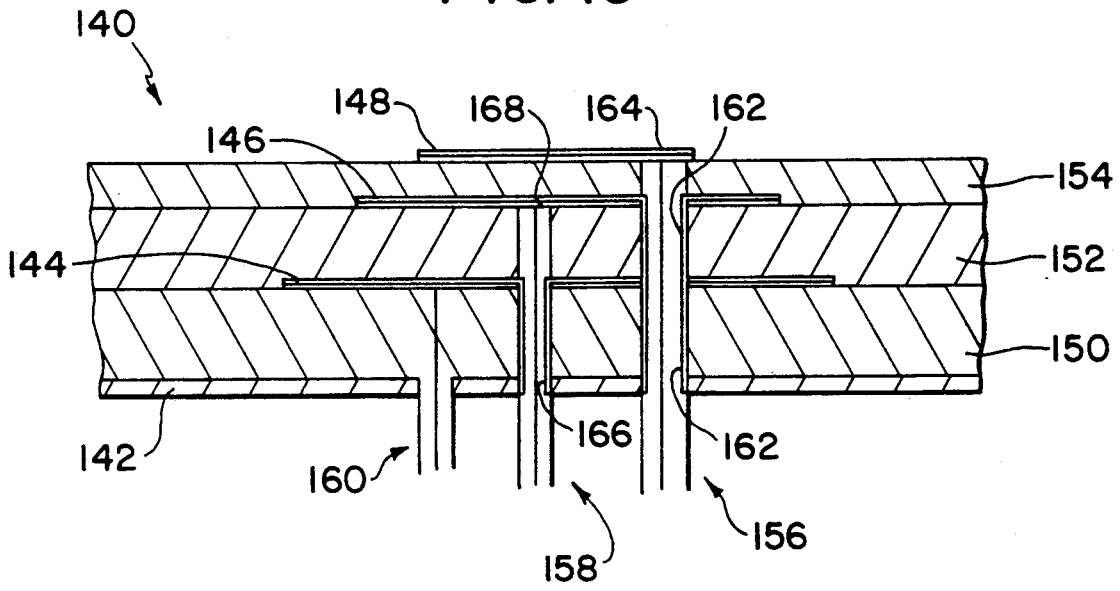
FIG. 13 is a cross-sectional view of another embodiment of a multiple-frequency antenna structure of the present invention.
Figure 14:
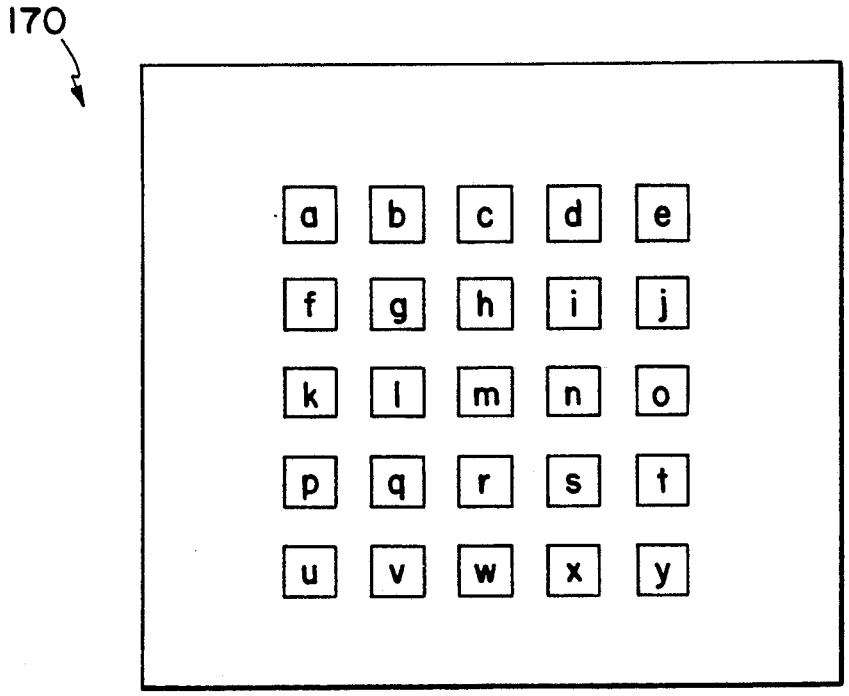
FIG. 14 illustrates an embodiment of the present invention in which the antenna sections are arranged in an array.

FIG. 13 illustrates another embodiment of an antenna structure 140 of the present invention in which additional frequencies can be accommodated by employing additional stacked radiating elements and associated feed elements. Antenna structure 140 is adapted for operation on three frequencies; however, it can be constructed to provide even more frequencies if desired. Antenna structure 140 includes a reference surface 142, a first radiating element 144, a second radiating element 146 and a third radiating element 148. First radiating element 144 is substantially parallel to reference surface 142 and is separated therefrom by first dielectric layer 150; second radiating element 146 is substantially parallel to first radiating element 144 and is separated therefrom by a second dielectric layer 152; and third radiating element 148 is substantially parallel to second radiating element 146 and is separated therefrom by a third dielectric layer 154. First, second and third feed elements 160, 158 and 156, respectively, are secured to the underside of reference surface 142 and connect third, second and first radiating elements 148, 146 and 144, respectively, with a transmitting/receiving device. Each radiating element and its associated feed element comprise an antenna section.

Antenna structure 140 also includes an isolating means having a first shielding component 162 disposed around a portion of third feed element 156 through first and second dielectric layers 150 and 152. First shielding component 162 includes electrically conductive material on the walls of openings through first and second dielectric layers 150 and 152 to electrically connect reference surface 142 with second radiating element 146 at a position on second radiating element 146, preferably in substantial registration with a feed point 164 on third radiating element 148. Similarly, a second shielding component 166 is disposed around a portion of second feed element 158 through first dielectric layer 150. Second shielding component 166 includes electrically conductive material on the walls of the opening through first dielectric layer 150 to electrically connect reference surface 142 with first radiating element 144 at a location on first radiating element 144, preferably in substantial registration with a feed location 168 on second radiating element 146. First shielding component 162 causes second radiating element 146 to serve as a reference surface for third radiating element 148 and second shielding component 166 causes first radiating element 144 to serve as a reference surface for second radiating element 146. Energy from first radiating element 144 radiates from apertures defining a cavity between reference surface 142 and first radiating element 144. Energy from second radiating element 146 radiates from apertures defining a cavity between first radiating element 144 and second radiating element 146. Energy from third radiating element 148 radiates from apertures defining a cavity between second radiating element 146 and third radiating element 148.

Thus, each antenna section is substantially isolated from each other antenna section providing the improved performance characteristics discussed above with respect to the embodiments illustrated in FIGS. 1 and 7. Further isolation and tailored ripple and roll-off characteristics can be obtained by including a tuning network for each of first, second and third feed elements 160, 158 and 156, such as with stripline circuits disposed below reference surface 142. When the radiating elements are progressively larger from the upper element toward the reference surface and the feed locations are alternatively positioned on opposite sides of a vertical axis through the center of each radiating element, the spacing between feed elements is increased. Mutual coupling is thereby reduced.

In still another embodiment, FIG. 13 illustrates an antenna structure 170 having multiple sets of antenna sections arranged as an array to achieve desired gain and directivity characteristics. The array illustrated in FIG. 13 includes twenty antenna sections (a–y) arranged in a 5×5 matrix. It will be appreciated, of course, that other layouts employing fewer or greater numbers of antenna sections and other patterns can also be used. Each antenna section includes two or more stacked radiating elements, associated feed elements and associated isolating components. Tuning networks can also be incorporated in the array for each antenna section. To improve directivity of antenna structure 170, appropriate phasing circuitry can be employed for fixed or electrical scanning. The design of such an array is facilitated, and its performance enhanced, because the radiation phase centers of each antenna section substantially coincide.

A further advantage of the multi-frequency antenna array illustrated in FIG. 13 is that stacked radiating elements require less space than if all of the radiating elements were substantially coplanar, perhaps arranged with radiating elements of one frequency adjacent to radiating elements of another frequency.

Although the present invention has been described in detail, it should be understood that various changes, substitutions and alterations can be made herein without departing from the spirit and scope of the invention as defined by the appended claims.

What is claimed is:

1. A multiple-frequency antenna structure, comprising:

a first electrically conductive reference surface;

a first microstrip radiating element dimensioned to transmit/receive at a first resonant frequency and having a feed location, said first radiating element being disposed above and substantially parallel to said first reference surface and separated therefrom by a first dielectric layer;

a second microstrip radiating element dimensioned to transmit/receive at a second resonant frequency and having a feed location, said second radiating element being disposed above and substantially parallel to said first radiating element and separated therefrom by a second dielectric layer;

first feed means extending through said first reference surface and said first dielectric layer and electrically connected to said first radiating element;

second feed means extending through said first reference surface, said first and second dielectric layers and said first radiating element and electrically connected to said second radiating element, said second feed means including a first portion disposed through said first dielectric layer; and first isolating means for substantially isolating operation of the antenna structure at said first and second resonant frequencies, said first isolating means including:

first shielding means disposed around said first portion of said second feed means, free from contact therewith, for electrically connecting said first reference surface to said first radiating element;

first and second tuning networks, each having band-pass filter characteristics and being disposed below and substantially parallel to said first reference surface and separated therefrom by a third dielectric layer, said first tuning network being electrically interconnected between said first feed means and transmitting/receiving means;

and said second tuning network being electrically interconnected between said second feed means and said transmitting/receiving means.

2. A multiple-frequency antenna structure, as claimed in claim 1, wherein:

said first reference surface, said first and second dielectric layers and said first radiating element each have a first opening formed therethrough in substantial registration with said feed location on said second radiating element;

said first reference surface and said first dielectric layer both have a second opening formed therethrough in substantial registration with said feed location on said first radiating element;

said first feed means includes a first signal-carrying conductor disposed through said second openings and electrically connected to said feed location on said first radiating element;

said second feed means includes a second signal-carrying conductor disposed through said first openings and connected to said feed location on said second radiating element; and said first shielding means is electrically connected to said first reference surface and said first radiating element at locations thereon in substantial registration with said feed location on said second radiating element.

3. A multiple-frequency antenna structure as claimed in claim 2, said first shielding means including:

electrically conductive material disposed on the walls of said first opening through said second dielectric layer, said conductive material electrically connecting said first reference surface to said first radiating element at a location adjacent to said first openings in said first radiating element and said first reference surface.

4. A multiple-frequency antenna structure, as claimed in claim 1, wherein:

said first tuning network includes a first stripline circuit; and said second tuning network includes a second stripline circuit.

5. A multiple-frequency antenna structure, as claimed in claim 4, said first stripline circuit including a first open circuited transmission line and said second stripline circuit including a second open circuited transmission line, wherein said first and second radiating elements are capable of transmitting/receiving co-polarized radiation with:

said first and second resonant frequencies being separated by about 20 percent of the higher of said first and second resonant frequencies;

said first and second radiating elements each having a 2.0:1 VSWR bandwidth of at least about 10 percent; and the antenna structure having a port-to-port isolation of at least 20 dB at each of said first and said second resonant frequencies.

6. A multiple-frequency antenna structure, as claimed in claim 5, wherein said second open circuited transmission line is spaced from and substantially parallel to said first open circuited transmission line.

7. A multiple-frequency antenna structure, as claimed in claim 1, further comprising:

at least a third microstrip radiating element dimensioned to transmit/receive at a third resonant frequency and having a feed location, said at least third radiating element being disposed above and substantially parallel to said second radiating element and separated therefrom by a fifth dielectric layer;

at least a third feed means extending through said first reference surface, said first, second and fifth dielectric layers and said first and second radiating elements and electrically connected to said third radiating element; said third feed means including a first portion disposed within said first and second dielectric layers; and second isolating means for substantially isolating operation of the antenna structure at said first, second and third resonant frequencies, said second isolating means including:

second shielding means disposed around said first portion of said third feed means, free from contact therewith, for electrically connecting said first reference surface to said first and second radiating elements; and a third tuning network having a bandpass filter characteristics and being disposed below and substantially parallel to said first reference surface and substantially co-planar with said first and second tuning networks, said third tuning network being electrically interconnected between said at least third feed means and said transmitting/receiving means.

8. A multiple-frequency antenna structure, as claimed in claim 7, wherein:

said first reference surface, said first, second and fifth dielectric layers and said first and second radiating elements each have a third opening formed therethrough in substantial registration with said feed location on said at least third radiating element;

said second shielding means is electrically connected to said first and second radiating elements and said first reference surface at locations thereon in substantial registration with said feed location on said at least third radiating element.

9. A multiple-frequency antenna structure, as claimed in claim 8, said second shielding means including:

electrically conductive material disposed on the walls of said third openings through said first and second dielectric layers, said conductive material electrically connecting said first reference surface to said first and second radiating elements at locations adjacent to said third openings in said first and second radiating elements and said first reference surface.

10. A multiple-frequency antenna structure, as claimed in claim 1, further comprising:

a plurality of first radiating elements; and a like plurality of corresponding second radiating elements, said first and second radiating elements having an array arrangement.

11. A multiple-frequency antenna structure, as claimed in claim 1, wherein the positions of said feed locations on said first and second radiating elements and the position of said second radiating element relative to said first radiating element are selected whereby a first radiation phase center of said first radiating element substantially coincides with a second radiation phase center of said overlying second radiating element.

12. A multiple-frequency antenna structure, as claimed in claim 1, wherein the positions of said feed locations on said first and second radiating elements are selected to accommodate substantially co-polarized signals transmitted/received by said first and second radiating elements.

13. A multiple-frequency antenna structure, as claimed in claim 1, further comprising:

a second electrically conductive reference surface disposed below and substantially parallel to said first and second tuning networks and separated therefrom by a fourth dielectric layer.

14. A multiple-frequency antenna structure, as claimed in claim 13, further comprising:

first interconnect means for electrically connecting said transmitting/receiving means with said first tuning network; and second interconnect means for electrically connecting said transmitting/receiving means with said second tuning network.

15. A multiple-frequency antenna structure, as claimed in claim 14 wherein:

said first interconnect means comprises a third signal-carrying conductor disposed through openings formed in said second reference surface and said fourth dielectric layer; and said second interconnect means comprises a fourth signal-carrying conductor disposed through openings formed in said second reference surface and said fourth dielectric layer.

16. A multiple-frequency antenna structure, as claimed in claim 15, further comprising:

a first reference conductor associated with a portion of said third signal-carrying conductor and electrically connected to said second reference surface; and a second reference conductor associated with a portion of said fourth signal-carrying conductor and electrically connected to said second reference surface.

* * * * *